US006039532A

United States Patent [19]

McConnell

[11] Patent Number: 6,039,532

[45] Date of Patent: Mar. 21, 2000

[54] BLOWER FAN BLADE PASSAGE RATE NOISE CONTROL SCHEME

[75] Inventor: Kenneth G. McConnell, Ames, Iowa

[73] Assignee: Iowa State University Research Foundation, Inc., Ames, Iowa

[21] Appl. No.: 08/895,726

[22] Filed: Jul. 17, 1997

Related U.S. Application Data

[60] Provisional application No. 60/021,958, Jul. 18, 1996.

[51] Int. Cl.[7] ..... F01D 5/10

[52] U.S. Cl. ..... 415/119; 415/206; 415/208.3; 415/211.1

[58] Field of Search ..... 415/119, 211.1, 415/206, 208.3, 204, 205

[56] References Cited

U.S. PATENT DOCUMENTS 3,034,702 5/1962 Larsson et al. ..... 230/128
3,687,360 8/1972 Prew et al. ..... 233/46
4,680,006 7/1987 Fisher ..... 431/265
5,279,515 1/1994 Moore et al. ..... 415/119
5,340,275 8/1994 Eisinger ..... 415/119
5,536,140 7/1996 Wagner et al. ..... 415/119

*Primary Examiner*—Edward K. Look
*Assistant Examiner*—Ninh Nguyen
*Attorney, Agent, or Firm*—Zarley, McKee, Thomte, Voorhees & Sease

[57] ABSTRACT

An blower of the squirrel cage type that includes a baffle extending from the cut-off area between the impeller and the air outlet for providing a gradual decrease in air flow area between the impeller and the housing. The baffle decreases in width with a leading edge that follows a linear or non-linear curve to effect the gradual change in air flow area. This gradual change in the air flow area reduces the pressure pulse at the cut-off area and thereby reduces noise and vibration and improves the efficiency of the blower.

2 Claims, 3 Drawing Sheets

BLOWER FAN BLADE PASSAGE RATE NOISE CONTROL SCHEME

CROSS-REFERENCE TO RELATED APPLICATION

This application is a continuation of co-pending, commonly owned United States provisional application Ser. No. 60/021,958 filed Jul. 18, 1996, entitled BLOWER FAN BLADE PASSAGE RATE NOISE CONTROL SCHEME. Priority is claimed under 35 U.S.C. §120.

BACKGROUND OF THE INVENTION

The present invention relates to air circulation devices and, more particularly, air circulation devices of the squirrel cage type.

Centrifugal fans or blowers, also commonly referred to as squirrel cage blowers, are ubiquitous. They are used in such things as home appliances, office equipment, and automobile heater/AC units. The operating principal is the same for all centrifugal blowers. The air is drawn in at the inlet by a rotating impeller which is driven by a motor and contains a number of passages arranged in a spiral pattern. On flowing through these passages the air is given an acceleration and emerges at the outlet under pressure from the blower housing.

Such blowers are also characterized by a cut-off area formed at the intersection of the outlet housing and the radial housing which encases the impeller (see FIG. 3). One problem with these blowers is that the cut-off area causes an abrupt change in the tangential and radial air flow area that is available. That is, the air flow through the impeller is restricted abruptly as it passes the cut-off area. This sudden change the in the air flow area disrupts the flow pattern and causes a large pressure pulse to occur at regular timed intervals, which in turn causes a near monotone sound. Thus, there is a need in the art for an improved centrifugal blower or squirrel cage type blower that causes a much smaller pressure pulse to occur at the cut-off and thus reduces noise and vibration and improves efficiency.

It can therefore be seen that there is a real and continuing need for the development of an improved squirrel cage type blower that reduces noise and vibration and improves efficiency.

The primary objective of the present invention is the provision of an improved squirrel cage type blower that reduces or eliminates the abrupt change in air flow area at the cut-off area.

Another objective of the present invention is the provision of an improved squirrel cage type blower that effects a gradual change in the air flow area to cause a much smaller pressure pulse to occur, and hence, reduces noise and vibration.

Another objective of the present invention is the provision of a method of reducing the noise and vibration and improving the efficiency of a squirrel cage type blower.

Still another objective of the present invention is the provision of an improved squirrel cage type blower that is efficient in operation, economical to manufacture, and durable in use.

These and other features, objectives, and advantages will become apparent to those skilled in the art with reference to the accompanying specification.

SUMMARY OF THE INVENTION

The foregoing objectives are achieved in a preferred embodiment of the invention by an improved blower of the squirrel cage type that has a baffle extending from the cut-off area between the impeller and the outlet, which provides a gradual decrease in the air flow area between the impeller and the housing. In its preferred form, the baffle is convexed in cross-section and extends from a first end to a second end at least partially enclosing the impeller. The baffle decreases in width between the first and second ends with the leading edge of the baffle following a linear or non-linear curve. This preferred embodiment effectively extends the cut-off area so that the decrease in tangential and radial air flow area occurs over a greater angle relative the shaft of the impeller. As such, the pressure pulse and resulting noise and vibration are significantly reduced.

DETAILED DESCRIPTION OF THE PREFERRED EMBODIMENT

Figure 1:
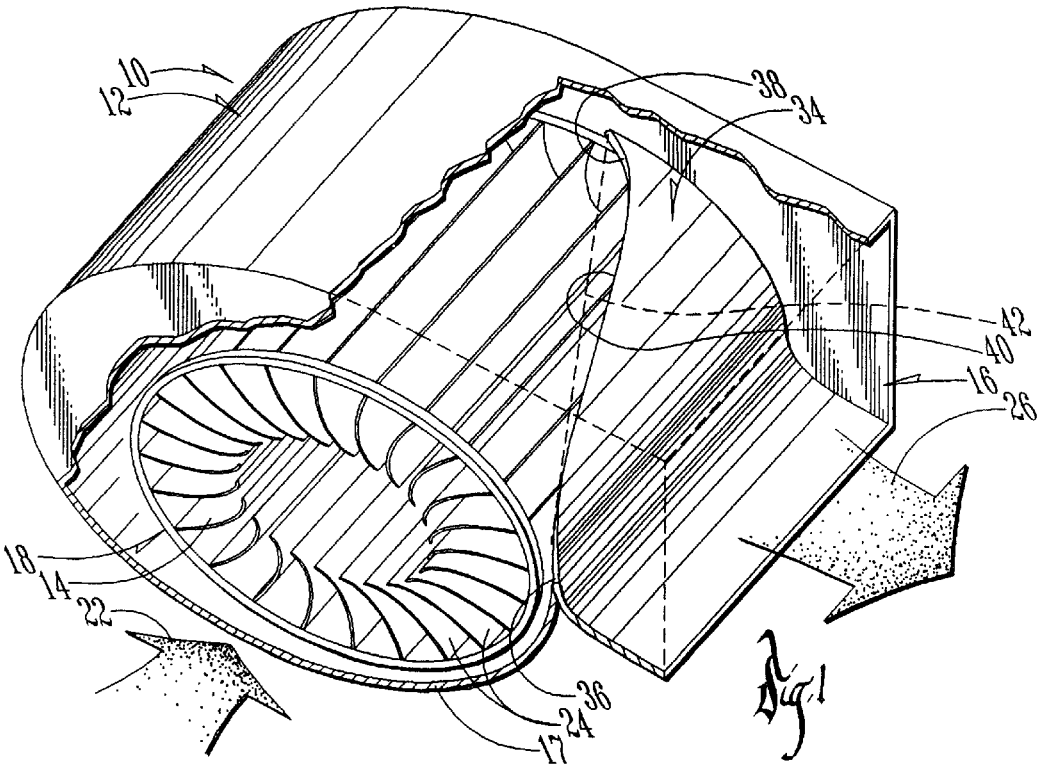
FIG. 1 is a cut-away perspective view of the improved blower of the present invention.

FIG. 1 shows a squirrel cage type blower 10 having a hollow housing 12 that forms an air inlet 14 and an air outlet 16. The housing 12 also includes a radial wall 17 that partially encloses the impeller 18. The impeller is mounted on a shaft 20 within the housing 12 (see FIG. 2). The air is drawn in through the inlet 14 in the direction of the arrow 22 by the rotating impeller 18, which is driven by a motor (not shown) and includes a plurality of blades 24 arranged in a series. On flowing through the passages between the blades 24, the air is given an acceleration and emerges under pressure from the radial wall 17 of the housing 12 and through the outlet 16 in the direction of the arrow 26.

Figure 3:
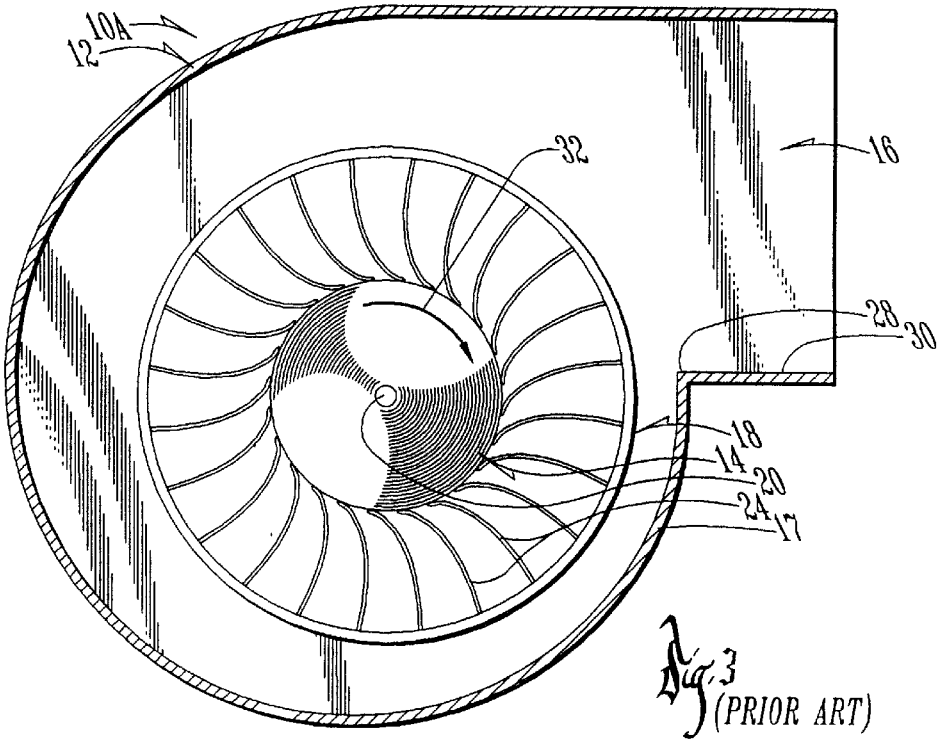
Fig. 3 (PRIOR ART)
FIG. 3 is a side elevational view, similar to FIG. 2, of a prior art blower.

FIG. 3 shows a typical prior art squirrel cage blower 10A. Note that a cut-off area 28 is formed between the radial wall 17 of the housing 12 and an outlet wall 30 of the housing 12 that forms a portion of the air outlet 16. The outlet wall 30 lies generally in a plane that intersects the impeller 18.

Figure 6:
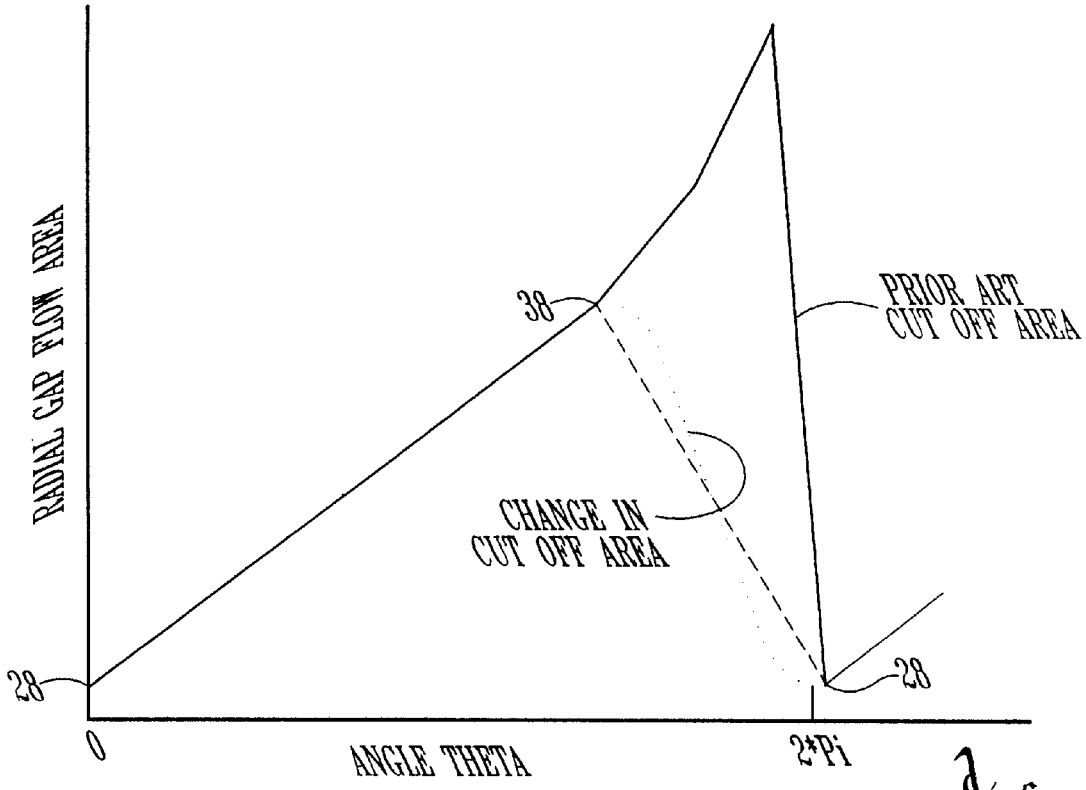
FIG. 6 is a graph of radial gap flow area versus angle theta.

Note that the tangential and radial air flow area between the impeller 18 and the housing 12 increases from the cut-off area 28 in the direction of rotation of the impeller (as shown by directional arrow 32) until returning again to the cut-off area 28, where there is a drastic decrease in the air flow area. That is, the flow through the impeller is cut off abruptly as it passes the cut-off area 28. This sudden change in air flow area changes the flow pattern and causes a large pressure pulse to occur at regular timed intervals which in turn causes a near monotone sound. As shown by the graph in FIG. 6, at the cut-off the air flow area decreases nearly instantaneously back to its original value. It is evident from FIG. 6 that the rate of change in area at the cut-off, i.e., the slope of the curve, is drastic. It was thus identified that the rate of change of air flow area is a source of much unwanted noise and vibration at the cut-off area 28.

Figure 2:
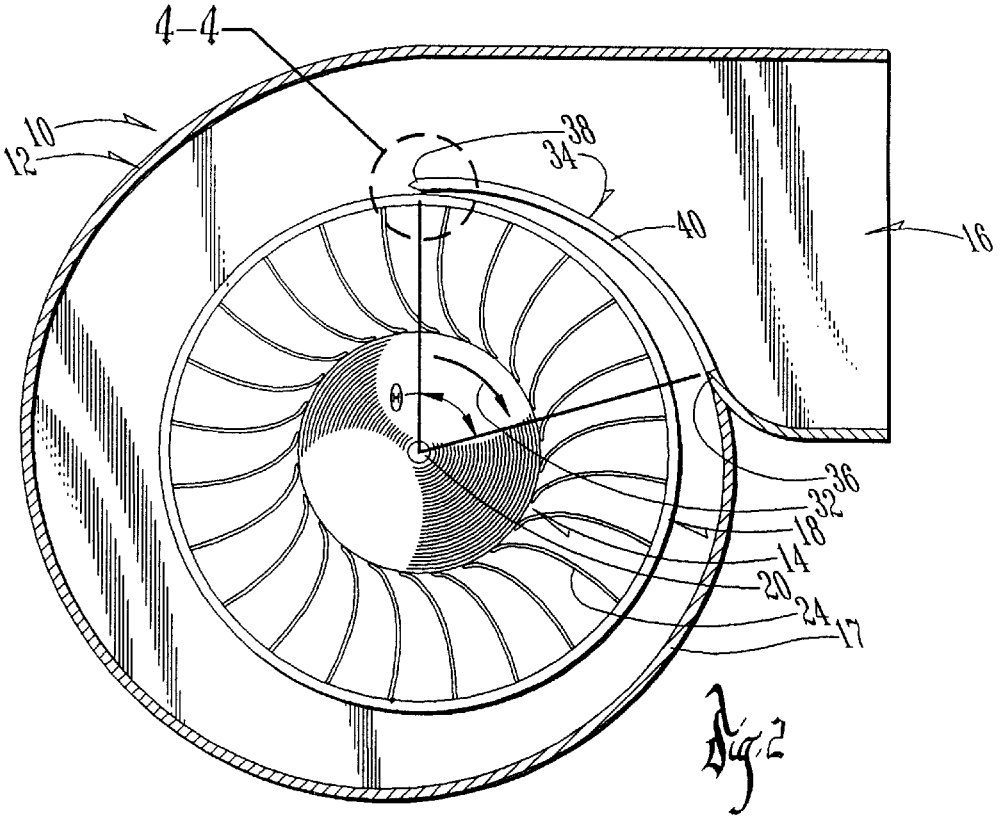
FIG. 2 is a side elevational view of the blower of FIG. 1.

The improved squirrel cage blower 10 of the present invention is shown most clearly in FIGS. 1 and 2. The improved design effectively extends the cut-off area 28 over a greater angle θ (as measured relative the shaft 20 of the impeller 18) so that there is a gradual decrease in air flow area to reduce the pressure pulse and resulting noise and vibration at the original cut-off area 28. To effect this gradual change in air flow area, a baffle 34 having a first end 36 and a second end 38 is convexed in cross-section and extends from the cut-off area 28 around at least a portion of the impeller 18. As shown in FIG. 1, the baffle 34 has a leading edge 40 that is slanted or curved so that there is a gradual decrease in the width of the baffle 34 from the first end 36 to the second end 38. As such, one end of the cut-off 28 is effectively moved to the second end 38 of the baffle while the other end stays at or near the original cut-off area 28. Hence, the cut-off begins when the impeller blade 24 passes the second end 38 of the baffle 34 and continues to cut-off the flow into the discharge area until the blade 24 passes the original cut-off area 28 or first end 36 of the baffle 34. This means that the cut-off process occurs over an angle theta θ that can be as large as 90° or more as needed. Angle θ ranges between 30° and 120° have been tested and proved successful in reducing noise and vibration and improving efficiency. Angles between 60° and 90° are preferred, with a 90° angle generally providing the most gradual transition in air flow area.

In its preferred form, the leading edge 40 of the baffle 34 substantially follows a 1-cosine (β) curve. A linear curve (as shown by the dotted line 42) or any other curve that similarly effects a gradual change the air flow area could also be used. Furthermore, it has been found that a baffle 34 which is convex in cross-section as shown in FIG. 2 is normally most effective as it matches the average design air flow of the blower. However, it should be understood that other configurations, linear or otherwise, may also be used.

Figure 4:
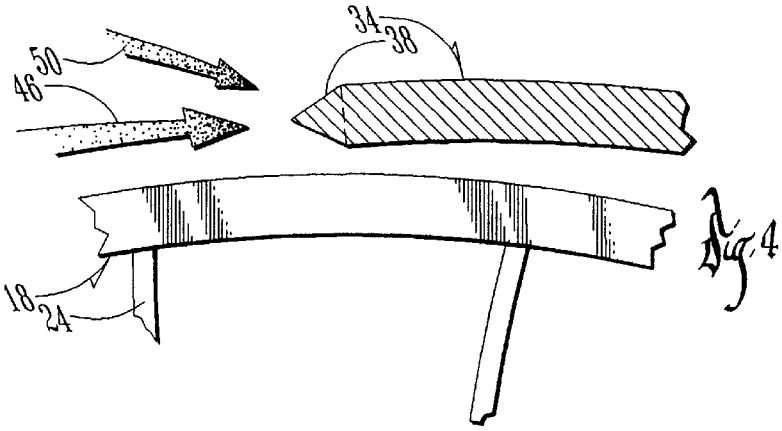
FIG. 4 is an enlarged partial view of FIG. 2 showing the leading edge of the baffle.
Figure 5:
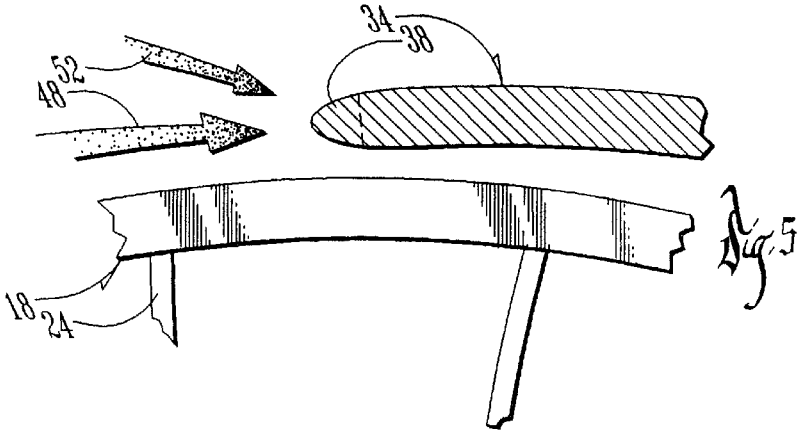
FIG. 5 is an enlarged partial view, similar to FIG. 4, showing an alternative curvature for the leading edge of the baffle.

It is also important to have the cut-off angle at the second end 38 of the baffle 34 match the average design flow rate through the blower 10 as shown in FIGS. 4 and 5 so that the air flows onto the baffle 34 in a tangential direction. This smooth entry as shown by directional arrows 46 and 48 reduces the amount of noise and turbulence that would otherwise occur if the air impacts upon the baffle 34 structure, for example, as shown by directional arrows 50 and 52. By using this tangential design concept, the entry of the air onto the leading edge 40 of the baffle 34 is as efficient as possible and should give the quietest behavior over the largest flow rate region.

The leading edge of the baffle 40 can take different aerodynamic shapes, but a generally rounded edge (see FIG. 5) or pointed edge (see FIG. 4) is normally preferred.

Figure 7:
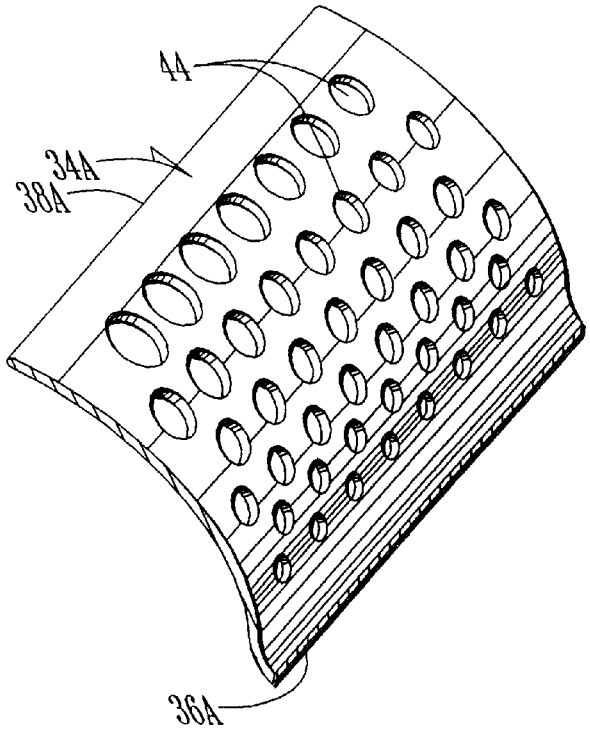
FIG. 7 is an alternative embodiment of the baffle for use with the present invention.

An alternative embodiment of the baffle 34 is shown in FIG. 7. This baffle 34A contains a plurality of apertures 44 that gradually increase in size from the first end 36A to the second end 38A of the baffle 34A. Designing the baffle 34A with progressively larger apertures creates at least to some extent the same effect as the baffle 34 of FIGS. 1 and 2.

Whereas the invention has been shown and described in connection with the preferred embodiments thereof, it will be understood that many modifications, substitutions, and additions may be made which are within the intended broad scope of the following claims. For example, although the present invention has been described it relates to the circulation of air, the blower may be used to circulate any other gas as well.

From the foregoing, it can be seen that the present invention accomplishes at least all of the stated objectives.

What is claimed is:

1. An blower of the squirrel cage type having an impeller mounted on its axis in a hollow housing, said housing having an air outlet, an air inlet, a radial wall adjacent said impeller, and an outlet wall partially defining said air outlet on a plane that intersects said impeller, said radial wall and said air outlet intersecting at a cut-off area, said improvement comprising:

a surface extending from said cut-off area between said impeller and said outlet for providing a gradual decrease in air flow area between said impeller and said housing, said surface having a plurality of apertures generally decreasing in size toward said cut-off area.

2. A method of reducing noise and vibration and improving the efficiency of a blower of the squirrel cage type having an impeller mounted on its axis in a hollow housing, said housing having an air outlet, and air inlet, a radial wall adjacent said impeller, and an outlet wall partially defining said air outlet on a plane that intersects said impeller, said radial wall and said air outlet intersecting at a cut-off area, said method comprising:

providing a surface extending from said cut-off area between said impeller and said outlet to effect a gradual decrease in air flow area between said impeller and said housing, said surface having a plurality of apertures generally decreasing in size toward said cut-off area.

* * * * *